United States Patent [19]

Maxwell

[11] Patent Number: 5,074,617

[45] Date of Patent: Dec. 24, 1991

[54] STORAGE COMPARTMENT FOR WHEELCHAIR

[76] Inventor: Len Maxwell, One Lincoln Plaza, New York, N.Y. 10023

[21] Appl. No.: 189,523

[22] Filed: May 3, 1988

[51] Int. Cl.[5] ..... A47C 7/54

[52] U.S. Cl. ..... 297/194; 297/411; 297/DIG. 4; 297/397

[58] Field of Search ..... 297/194, 113, 115, 116, 297/411, 114, DIG. 4; 292/251.5

[56] References Cited

U.S. PATENT DOCUMENTS

| | | | |
|---|---|---|---|
| 2,494,838 | 1/1950 | Slaughter | 297/194 |
| 2,513,860 | 8/1950 | Blue | 297/422 X |
| 3,083,998 | 4/1963 | Morris | 297/194 |
| 3,363,939 | 1/1968 | Gross | 297/116 |
| 3,522,887 | 8/1970 | Petersen | 211/14 |
| 3,586,276 | 6/1971 | O'Mahoney | 248/128 |
| 3,759,569 | 9/1973 | Bennet | 297/194 |
| 3,910,659 | 10/1975 | Peterson | 312/226 |
| 3,950,894 | 4/1976 | Dimaio | 292/251.5 |
| 4,174,866 | 11/1979 | Rhyan | 297/194 |
| 4,339,061 | 7/1982 | Dunn | 224/42.42 |
| 4,417,764 | 11/1983 | Marcus et al. | 297/194 |
| 4,526,348 | 7/1985 | Cammack | 403/191 X |
| 4,526,419 | 7/1985 | Bowman et al. | 297/153 |
| 4,730,869 | 3/1988 | Schumacher | 297/DIG. 4 |

FOREIGN PATENT DOCUMENTS

| | | | |
|---|---|---|---|
| 15465 | 12/1933 | Australia | 297/194 |

*Primary Examiner*—Peter R. Brown

*Attorney, Agent, or Firm*—Frishauf, Holtz, Goodman & Woodward

[57] ABSTRACT

A storage compartment for a wheelchair includes a lower tray for holding at least one item, the lower tray or a holding member for the lower tray, being bolted permanently to one arm of the wheelchair and the lower tray having an upper opening. A cover member is pivotally secured on the lower tray for covering the upper opening of the lower tray when the cover member is in a closed position, the cover member having an upper surface which provides an arm rest for a user of the wheelchair. Detachable storage compartments, and compartments for use with clothing guards, are also disclosed. The device is adaptable to all known wheelchairs, and can be used to replace existing arm rests.

31 Claims, 11 Drawing Sheets

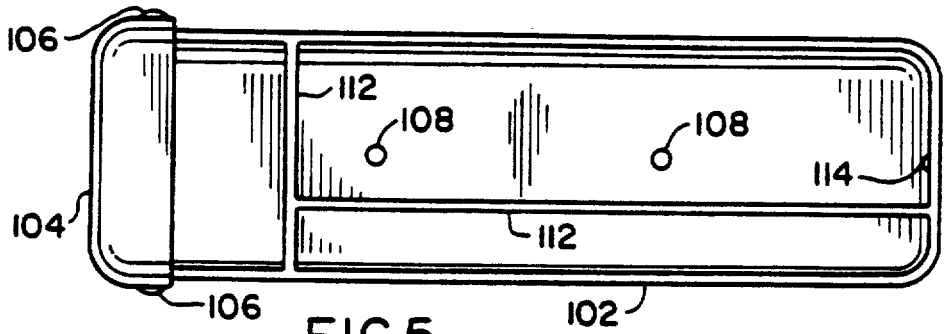
FIG.5
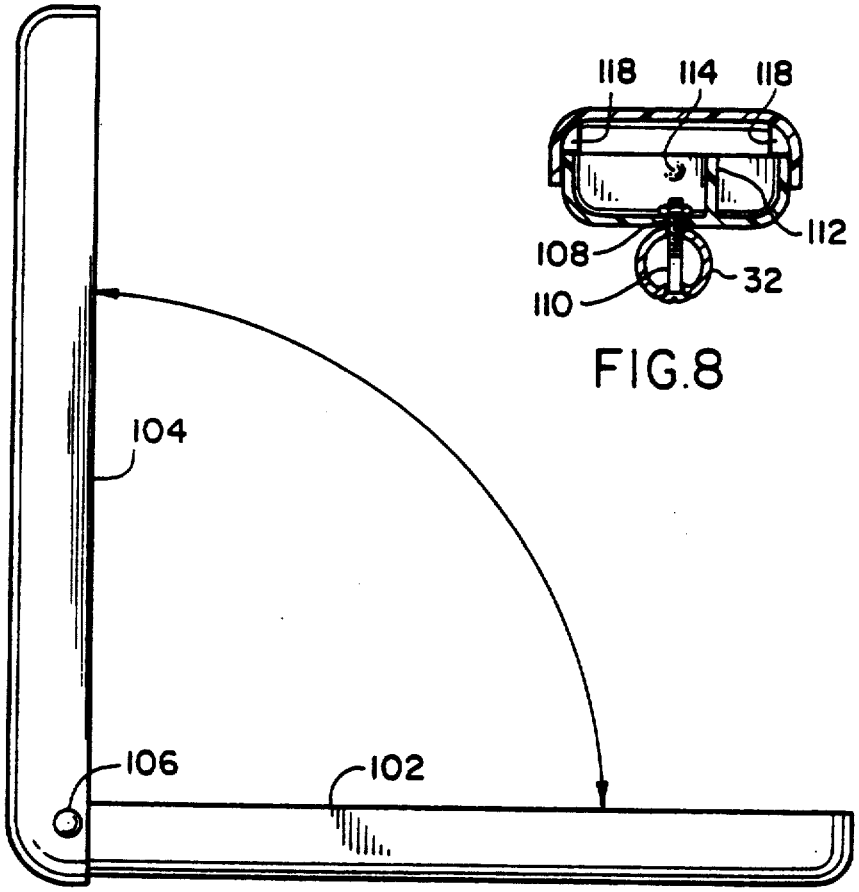
FIG.6
FIG.8
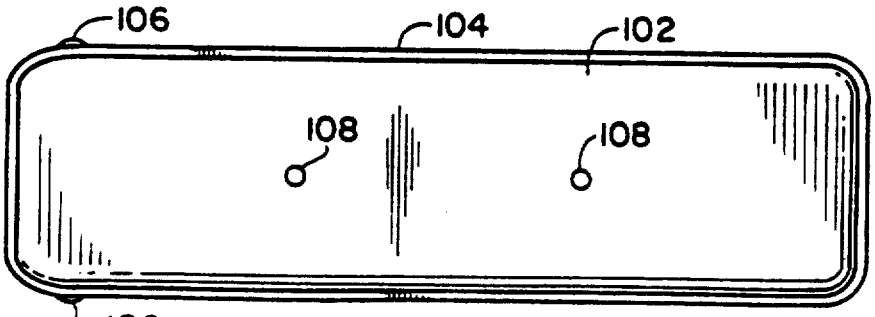
FIG.7

STORAGE COMPARTMENT FOR WHEELCHAIR

BACKGROUND OF THE INVENTION

This invention relates generally to wheelchairs, and more particularly, is directed to storage compartments for wheelchairs.

It is often desirable and necessary for individuals confined to a wheelchair to carry and/or store various items, such as eyeglasses, keys, money, pens, medicines, tissues, portable telephones and the like. However, conventional wheelchairs do not contain any permanently mounted storage device, located in a convenient place, to carry and/or store such items.

It is known to provide storage devices for various seats and/or chairs. For example, in U.S. Pat. No. 4,174,866 to Rhyan, a wheelchair is provided with a "cup" or glass retaining device which clips onto one of the arms of the wheelchair. However, this device is extremely limited as to use, and could not be used to conveniently carry such items as eyeglasses, keys, money and the like. Further, it is doubtful that such device could be used to carry such items, or even a cup of liquid, when the wheelchair is moving.

In U.S. Pat. No. 4,339,061 to Dunn, an accessory case is provided for a wheelchair. The accessory case is removably secured about one of the arms of the wheelchair by straps and hangs below the arm, and is separate from the arm rest. Although the case includes a main body and a pivoted cover member, connection of the case to the wheelchair by "Velcro"-type straps is not very secure. Also, the case occupies much space, and is therefore cumbersome. See also U.S. Pat. No. 3,586,276 to O'Mahoney with respect to an open basket that hooks onto a support such as a portable walker. This latter basket is also cumbersome. This device is for temporary attachment, contrary to the present invention.

The basket and tray attachment for wheelchairs, as described in U.S. Pat. No. 4,526,419 to Bowman et al, is also cumbersome and not practical for carrying the aforementioned items during movement of the wheelchair.

U.S. Pat. No. 3,522,887 discloses a support for a wheelchair, in which an open tray is supported just above one of the arms of the wheelchair. However, the tray is open so that it is not practical to carry many small items thereon. In any event, the tray is particularly adapted to carrying a bowling ball thereon and is arranged only for temporary attachment.

U.S. Pat. No. 3,759,569 to Bennet discloses a receptacle attachment for a wheelchair arm, in which the attachment is secured below the arm in a vertical position. The attachment pivots downwardly to a horizontal position to hold cups and the like. However, Bennet discloses that the attachment is only used for the temporary storage of items thereon.

U.S. Pat. No. 4,417,764 to Marcus et al. discloses an attachment type automobile arm rest assembly having a sliding tray therein which can be used to carry various items. However, in an automobile, there is a large amount of space to place such an arm rest, in comparison to the small, unstable confines of a wheelchair. In addition, the arm rest in an automobile is safe within the confines of the automobile, which is not the case with a wheelchair. Accordingly, such an automotive arm rest assembly, which is not an integral part of the surrounding structure, could not be readily adapted for use on a wheelchair.

U.S. Pat. No. 2,494,838 to Slaughter discloses a chair having arms which contain storage compartments therein. A cover member is pivotally secured on each arm and pivots to an open position, so as to function as a table or writing surface. However, since a chair of the type disclosed in Slaughter is very bulky as compared to a wheelchair, there is sufficient space to place such a storage compartment in the arm of the chair, which is not the case with a wheelchair. The same remarks apply when the compartment is formed in an automotive arm rest, as taught in U.S. Pat. No. 3,083,998 to Morris.

U.S. Pat. No. 3,363,939 to Gross discloses an invalid's chair having table supports which can be pivoted between a lower inoperative position and an upper, horizontal position. However, there is no disclosure of a storage compartment for a moving wheelchair.

OBJECTS OF THE INVENTION

Accordingly, it is an object of the present invention to provide a wheelchair storage device that overcomes the aforementioned disadvantages with the prior art. It is another object of the present invention to provide a wheelchair storage device that can be used to store a variety of items during movement of the wheelchair.

It is still another object of the present invention to provide a wheelchair storage device that can be used with conventional wheelchairs, and/or with modified wheelchairs having shorter vertical arm bars.

It is yet another object of the present invention to provide a wheelchair storage device that also functions as an arm rest, and which is removable and/or stationary relative to the rest of the wheelchair.

It is a further object of the present invention to provide a wheelchair storage device of the aforementioned type which includes a pivoted or hinged cover member that has a cushion unit secured thereon as an arm rest.

It is a still further object of the present invention to provide a wheelchair storage device of the aforementioned type which includes a partitioned interior.

It is a yet further object of the present invention to provide a wheelchair storage device of the aforementioned type which is permanently secured on the arms of the wheelchair, and is therefore an integral part of the construction of the wheelchair, and which provides high strength.

It is another object of the present invention to provide a wheelchair storage device of the aforementioned type which can be adjusted inwardly or outwardly of the arm to which it is attached.

It is still another object of the present invention to provide a wheelchair storage device of the aforementioned type having a removable tray therein.

It is yet another object of the present invention to provide a wheelchair storage device of the aforementioned type in which the cover member also functions as a table surface.

It is a further object of the present invention to provide various interchangeable wheelchair storage devices of the aforementioned type.

It is a still further object of the present invention to provide a wheelchair storage device that includes a slidable drawer secured to the underside of one of the arms.

It is yet another object of the present invention to provide an arm rest/storage device(s) that are all permanently a part of the wheelchair arm, whether the arm itself is permanent or removable.

The above and other objects, features and advantages of the present invention will become readily apparent from the following detailed description which is to be read in connection with the accompanying drawings.

SUMMARY OF THE INVENTION

In accordance with an aspect of the present invention, a storage compartment for a wheelchair of the type having at least one arm, includes lower tray means for holding at least one item, the lower tray means being secured to one the arm of the wheelchair and the lower tray means having an upper opening; and cover means pivotally secured on the lower tray means for covering the upper opening of the lower tray means when the cover means is in a closed position, the cover means having an upper surface which provides an arm rest for a user of the wheelchair.

In accordance with another aspect of the present invention, a storage compartment for a wheelchair of the type having at least one arm, includes lower tray means for holding at least one item, the lower tray means having an upper opening; cover means pivotally secured on the lower tray means for covering the upper opening of the lower tray means when the cover means is in a closed position, the cover means having an upper surface which provides an arm rest for a user of the wheelchair; and mounting flange means connected with one the arm of the wheelchair for releasably securing the lower tray means above the arm of the wheelchair.

In accordance with still another aspect of the present invention, a storage compartment for a wheelchair of the type having at least one arm, includes tray means for holding at least one item, the tray means having an upper opening; and housing means secured to one the arm of the wheelchair at a position beneath the arm, for slidably receiving the tray means therein, the housing means including a side opening for permitting partial withdrawal of the tray means from the housing means.

BRIEF DESCRIPTION OF THE DRAWINGS

FIG. 5 is top plan view of the wheelchair arm rest and storage compartment of FIG. 4, with the cover thereof in an open position;

FIG. 6 is a side elevational view of the wheelchair arm rest and storage compartment of FIG. 5;

FIG. 7 is a bottom plan view of the wheelchair arm rest and storage compartment of FIG. 5;

FIG. 8 is a cross-sectional view of the wheelchair arm rest and storage compartment of FIG. 4, taken along line 8—8 thereof;

DETAILED DESCRIPTION

Figure 1:
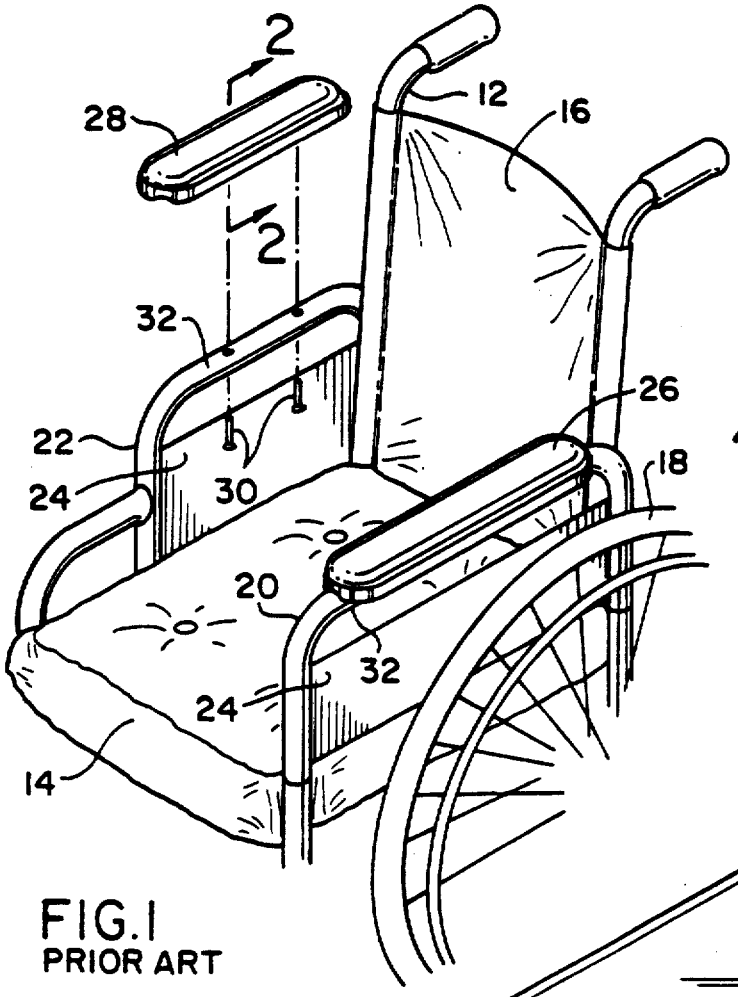
FIG.1 PRIOR ART
FIG. 1 is a partial perspective view of a wheelchair illustrating various, features of the prior art.
Figure 2:
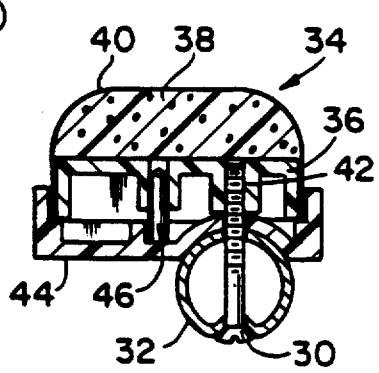
FIG.2 PRIOR ART
FIG. 2 is a detailed cross-section of the prior art arm rest of FIG. 1, taken along line 2—2 thereof, which is used on most wheelchairs.
Figure 3:
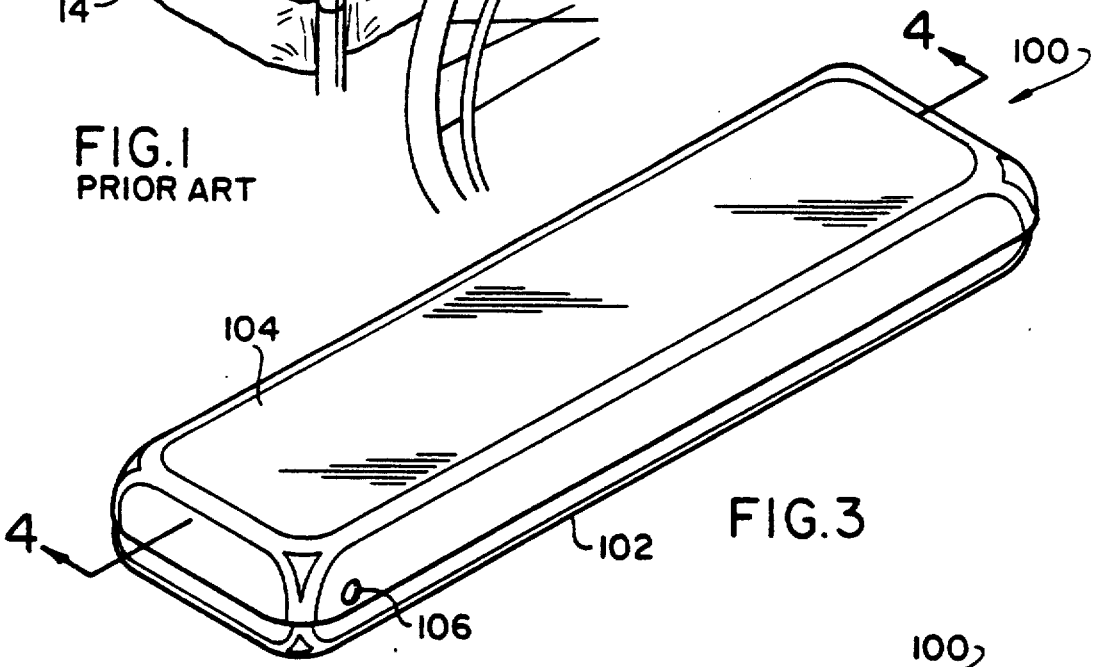
FIG. 3 is a perspective view of a combination wheelchair arm rest and storage compartment according to a first embodiment of the present invention.
Figure 4:
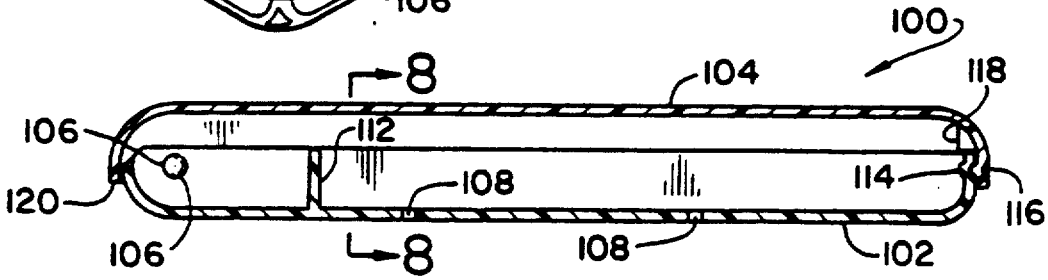
FIG. 4 is a cross-sectional view of the wheelchair arm rest and storage compartment of FIG. 3, taken along line 4—4 thereof.

Referring to the drawings in detail, and initially to FIGS. 1 and 2 thereof, a wheelchair 10 according to the prior art includes a frame 12 having a seat 14 and back 16 secured to frame 12. Wheelchair 10 further includes two wheels 18 rotatably mounted to frame 12 at opposite sides thereof so as to rotatably support wheelchair 10, and two substantially inverted U-shaped arm 20 and 22 also secured to frame 12 at opposite sides thereof. Arms 20 and 22 are purposely not shown as a matched pair, that is, arm 20 is illustrated as a full arm, while arm 22 is illustrated as a desk arm. In actuality, both arms of the wheelchair are constructed as full arms or desk arms. Desk arms allow for the wheelchair user to move closer to a table or desk. Further, as is conventional, arms 20 and 22 are either permanently attached to the wheelchair, or can be detachable therefrom. A clothing guard panel 24 is secured to each arm 20 and 22 within the area defined by the substantially U-shape thereof.

Arm rests 26 and 28 are mounted on top of arms 20 and 22, respectively, for the comfort of the user's arms. For the sake of brevity, the different embodiments of the present invention will be described as to only one side of the wheelchair, it being recognized that the opposite side of the wheelchair is a mirror image thereof.

Each arm 20 and 22 includes an upper horizontal member 32 having apertures 33 extending vertically therethrough. Arm rests 26 and 28 are fastened to the horizontal member 32 of the respective arms 20 and 22, by means of bolts 30 extending through apertures 33, as best shown in FIG. 2.

Each arm rest 26 and 28 includes a mounting plate 44 and an upper cushion unit 34 secured to mounting plate 44. Specifically, mounting plate 44 includes a base plate 43 and a circumferential side wall 45 secured to base plate 43. Base plate 43 also has an arcuate channel 47 along a lengthwise portion thereof, so as to receive the upper horizontal member 32 therein and be supported thereby. A plurality of apertures 49 extend through base plate 43 for receiving bolts 30 that extend through apertures 33 in upper horizontal members 32.

Upper cushion unit 34 is formed by a plastic base 36 and a foamed cushion 38 adhered thereon, foamed cushion 38 being covered by a sheet-like covering 40, such as a vinyl- type material, cloth, leather, or other suitable covering material. Plastic base 36 includes a plurality of screw- threaded bolt holes 42 which are aligned with apertures 49, so as to screw-threadedly receive bolts 30, and thereby secure arm rests 26 and 28 to arms 20 and 22, respectively. Plastic base 36 can be secured to base plate 43 by any suitable means, such as friction fit pins 46, adhesive or other suitable attachment means.

With the arrangement thus far described, various different stock arm rests can be secured on arms 20 and 22, depending upon the standards and uses set by the wheelchair manufacturer.

However, for individuals that are wheelchair bound, it is a particularly cumbersome task to carry and store many common items such as eyeglasses, money, wallet, comb or brush, writing instruments, medication, tissues, keys makeup, personal items, etc. The present invention is intended to overcome this problem by providing storage units for wheelchairs that can be installed during manufacture of the wheelchairs, as an option at the time of purchase, or as replacements units for existing arm rests 26 and 28. In some cases modification to conventional arms 20, 22, will be necessary, i.e., to shorten arms 20, 22 to accommodate higher storage-type arm rests.

Referring now to FIGS. 3–8, a wheelchair arm rest and storage compartment 100 according to a first embodiment of the present invention, is adapted to be mounted to a wheelchair and can be used for the storage of the above mentioned and other items, as desired by the user.

Specifically, the wheelchair arm rest and storage compartment 100 includes a lower tray member 102 and a cover member 104 pivotally secured on lower tray member 102 by pivot pins or rivets 106 such that cover member 104 pivots in the lengthwise direction of lower tray member 102. Lower tray member 102 is secured to each upper horizontal member 32 by bolts 110 extending through apertures 33 therein, and which further extend through bolt holes 108 in the bottom of lower tray member 102. The free ends of bolts 110 are secured by nuts 109 at the inside of lower tray member 102. The bottom of lower tray member 102 is completely flat, and does not include an arcuate channel such as channel 47 of FIG. 2. Accordingly, the upper portion of upper horizontal wheelchair member 32 could be flat to better mate with the flat bottom of lower tray member 102.

Alternatively, the lower side of lower tray member could have an arcuate channel, such as channel 47 of FIG. 2, formed therein, so as to better conform to the configuration of the round wheelchair member 32 to which it is attached. If the horizontal wheelchair member 32 has a rectangular cross-section, then a corresponding rectangular groove, or channel, conforming to the shape of the horizontal wheelchair member 32, could be formed in the lower surface of lower tray member 102 so as to provide better connection to the wheelchair member 32 and to provide a higher degree of structural integrity.

The upper member 104 could be padded, such as shown in FIGS. 1 and 2, or it could be made from a moldable material, such as plastic, which has a textured upper surface, as desired.

Figure 9:
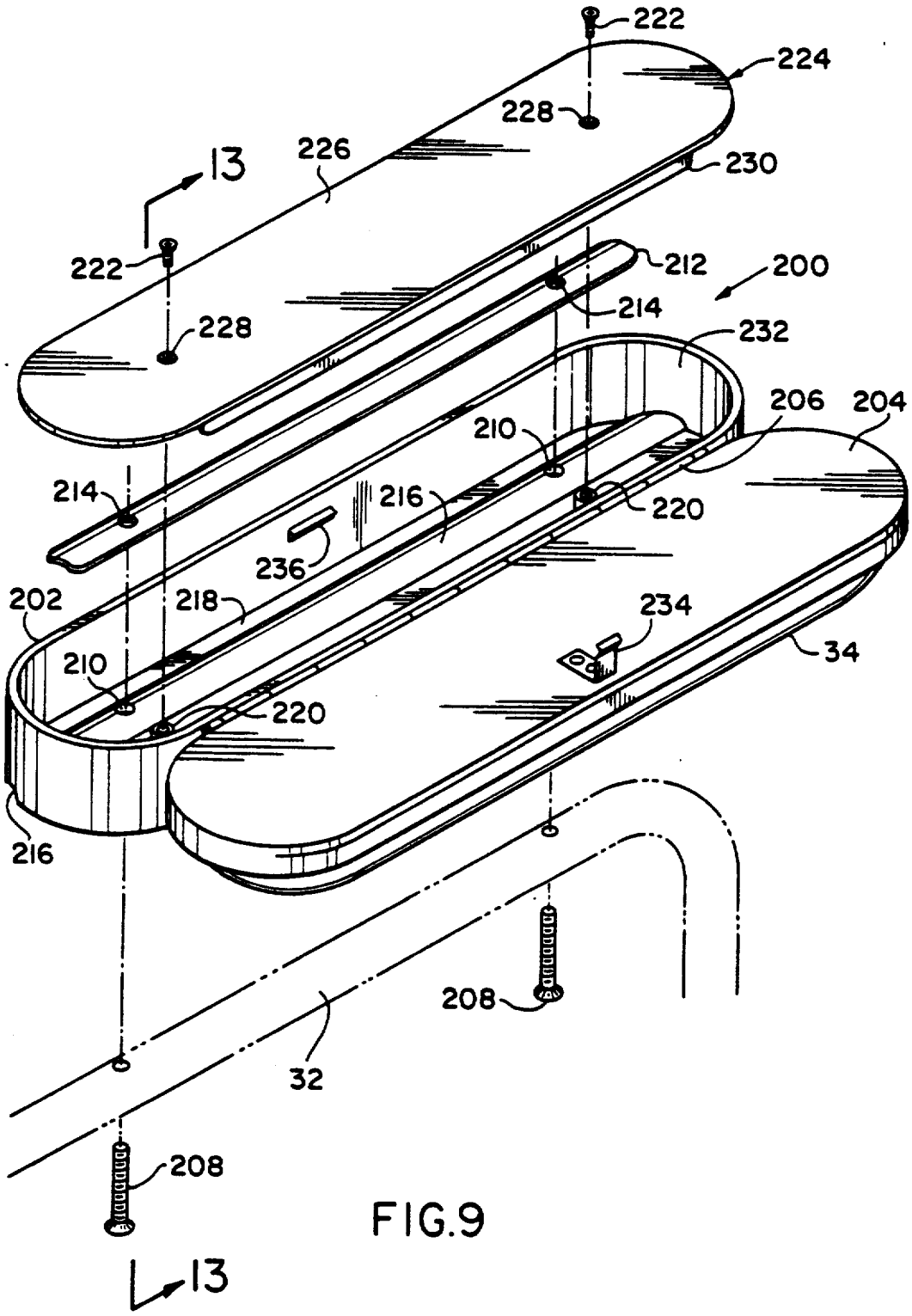
FIG. 9 is an exploded perspective view of a wheelchair arm rest and storage compartment according to a second embodiment of the present invention.
Figure 10:
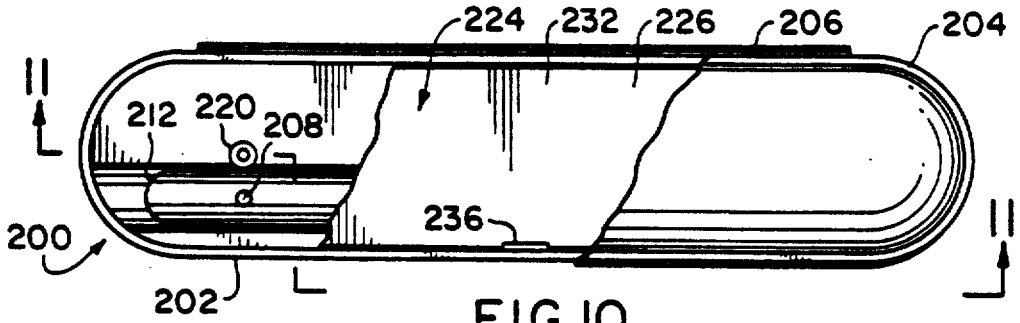
FIG. 10 is a top plan, partially broken away view of the wheelchair arm rest and storage compartment of FIG. 9.
Figure 11:
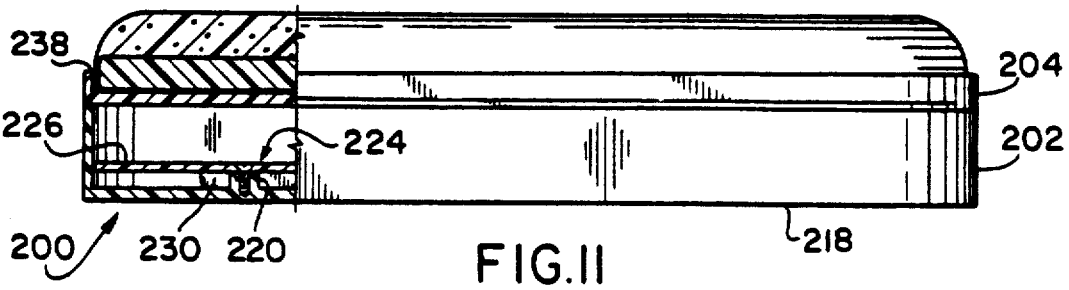
FIG. 11 is a side elevational view of the wheelchair arm rest and storage compartment of FIG. 10, shown partly in cross-section along line 11—11 thereof.
Figure 12:
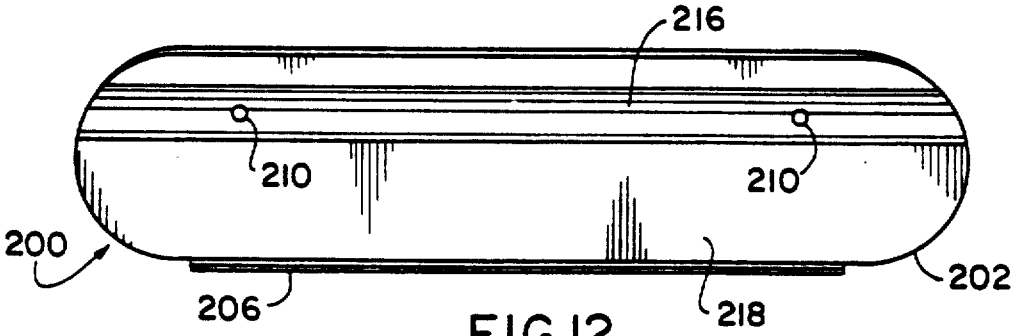
FIG. 12 is a bottom plan view of the wheelchair arm rest and storage compartment of FIG. 9.

Still further, an upper reinforcing bar or plate member 212, such as shown in FIG. 9, could be used in the inside of the lower tray member 102 to reinforce the structure, as will become apparent from the following discussion of FIG. 9.

Preferably, the inside of lower tray member 102 is compartmentalized by partitions 112, as best shown in FIG. 5. Although only three compartments are shown, it will be appreciated that the present invention is not limited thereby. A unit with only a single compartment could also be used.

In order to latch cover member 104 to lower tray member 102, a dimple 114 is formed in lower tray member 102 at the end thereof opposite pivot pins 106 so as to form an outwardly directed recessed section thereat. In like manner, a dimple 116 is formed in cover member 104 at the corresponding end and forms an inwardly directed detent that engages the recessed section of dimple 114 when cover member 104 is closed, so as to releasably lock cover member 104 to lower tray member 102. In order to correctly align the detent formed by dimple 116 with the recessed section formed by dimple 114, the inner surface of cover member 104, at a level above dimple 116 and at the corners of the non-pivoted end of cover member 104, is formed with corner standoff members 118 which sit on the upper surface of lower tray member 102, and which are supported thereby when cover member 104 is closed on lower tray member 102, as best shown in FIG. 8.

The pivoted end of cove member 104 includes a lip 120 which overlaps the pivoted end of lower tray member 102 at all times. Thus, lip 120 cooperates with the shape of lower tray member 102 and pivot pins 106, to maintain cover member 104 in an upright position, when open, as shown in FIG. 6.

Referring now to FIGS. 9–13, a wheelchair arm rest and storage compartment 200 according to a second embodiment of the present invention will now be described. Specifically, wheelchair arm rest and storage compartment 200 includes a lower tray member 202 and a cover member 204 hingedly secured on lower tray member 202 by hinges 206 such that cover member 204 opens in the widthwise direction of lower tray member 202. In such open position, the inner face of cover member 204 is horizontal, thus providing a useful work surface, for example, for the sorting of coins, holding a cup, glass, or food, etc.

Figure 13:
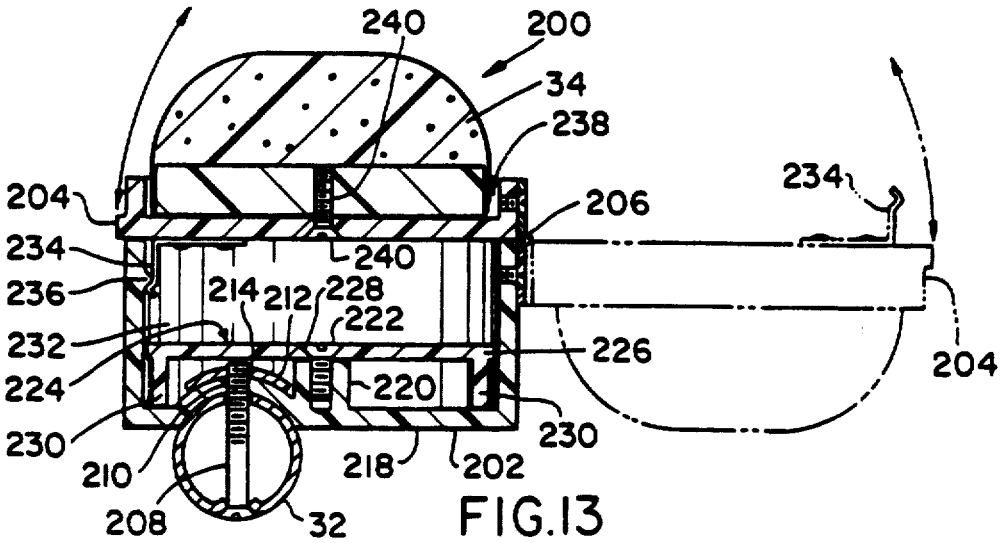
FIG. 13 is a cross-sectional view of the wheelchair arm rest and storage compartment of FIG. 9, taken along line 13—13 thereof.

Lower tray member 202 is secured to each upper horizontal member 32 by bolts 208 extending through apertures 33 therein, and which further extend through bolt holes 210 in the arcuate channel 216 in the bottom of lower tray member 202. The free ends of bolts 208 extend through screw-threaded apertures 214 in an arcuate clamp plate 212 positioned on the inner surface 218 of lower tray member 202 and seated on the convex inner surface thereat which is in opposition to arcuate channel 216, as best shown in FIG. 13.

In addition, the inner surface 218 of lower tray member 202 is formed with internally threaded bosses 220 extending vertically therefrom. A false bottom 224 includes an elongated platform 226 shaped to the interior of lower tray member 202 and supported on bosses 220, and stand-off leg members 230 extending downwardly from platform 226 and supported on inner surface 218 of lower tray member 202. False bottom 224 includes countersunk screw holes 228 in alignment with threaded bosses 220, for receiving screws 222 which are then threadedly received in bosses 220. Accordingly, false bottom 224 presents a smooth bottom to the compartment 232 defined by lower tray member 202 for storage of sundry articles. Of course, it is to be realized that false bottom 224 can be compartmentalized by partitions, as in the embodiment of FIG. 5.

In order to latch cover member 204 to lower tray member 202, an L-shaped spring clip 234 is riveted or otherwise fastened to the inner surface of cover member 204 and cooperates with a strike 236 secured to the inner, upper surface of the side wall of lower tray member 202. Other suitable latches could be used.

Cover member 204 is formed with a surrounding side wall 205 which defines a nest 238 for receiving an upper cushion unit 34. Upper cushion unit 34 is formed by a plastic base 235 having screw-threaded apertures 237 therein for receiving anchor screws 240 which extend through countersunk screw holes 241 in cover member 204. Upper cushion unit 34 also includes a foamed cushion 243 adhered on plastic base 235. Foamed cushion 243 can be covered by a sheet-like covering (not shown), such as a vinyl-type material, cloth, leather, or other suitable covering material.

Figure 14:
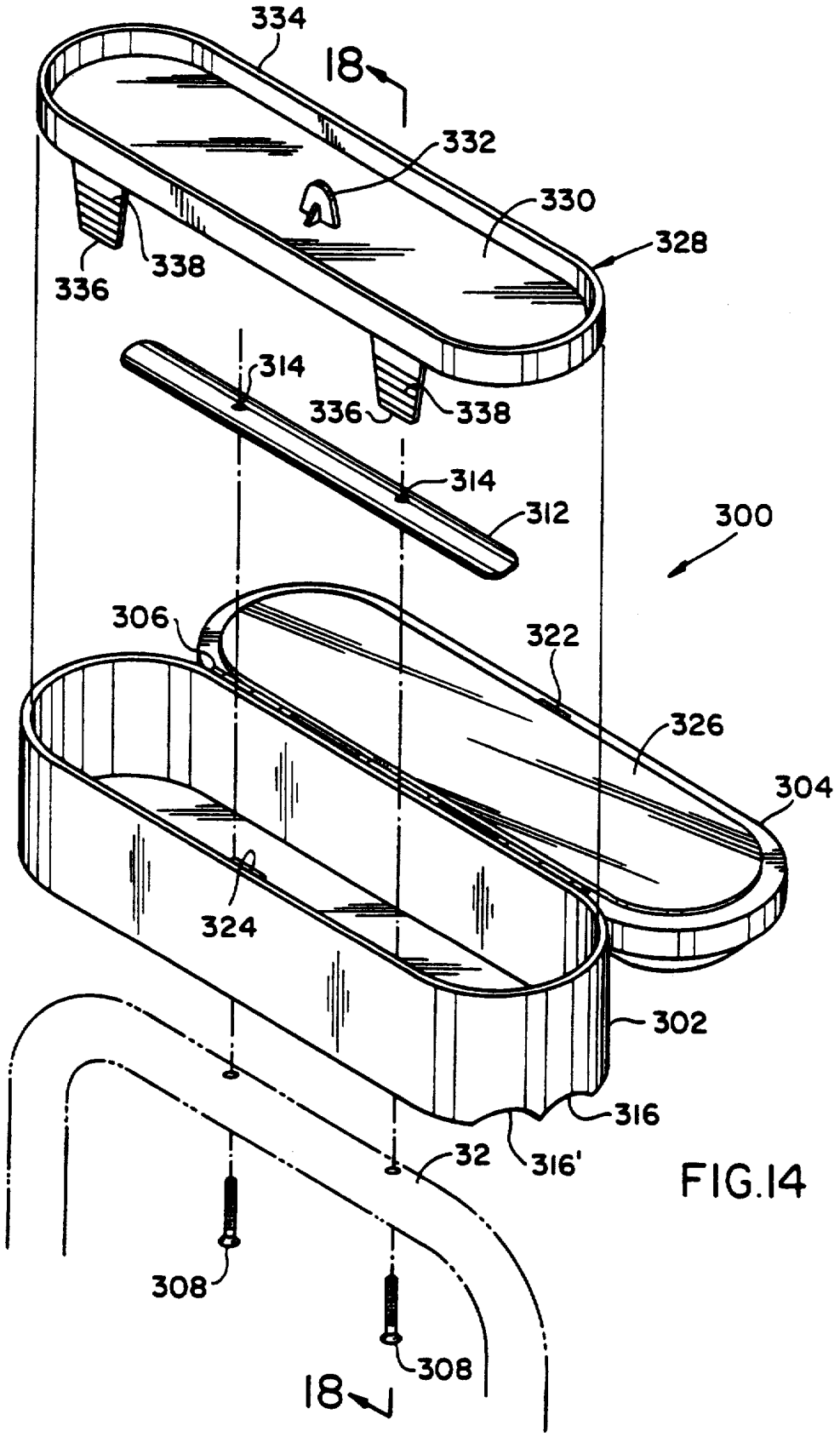
FIG. 14 is an exploded perspective view of a wheelchair arm rest and storage compartment according to a third embodiment of the present invention.
Figure 15:
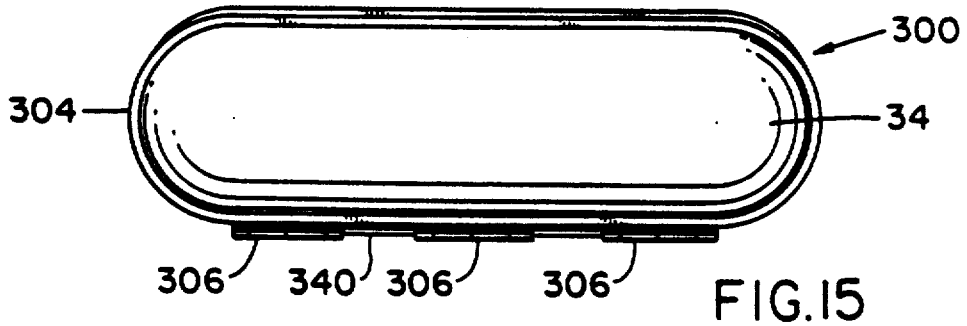
FIG. 15 is a top plan, partially broken away view of the wheelchair arm rest and storage compartment of FIG. 14.
Figure 16:
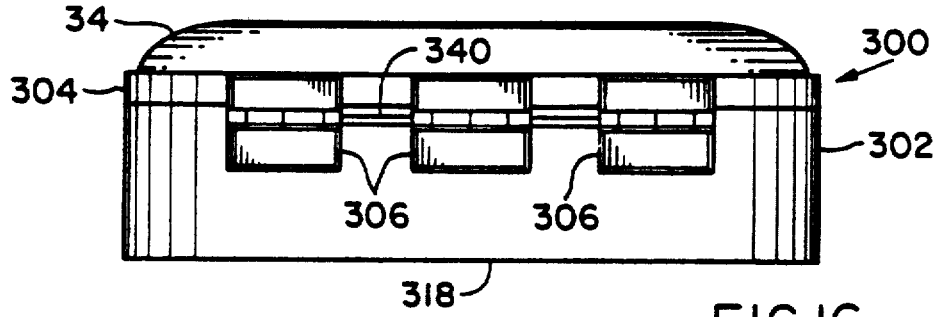
FIG. 16 is a hinge side elevational view of the wheelchair arm rest and storage compartment of FIG. 15.
Figure 17:
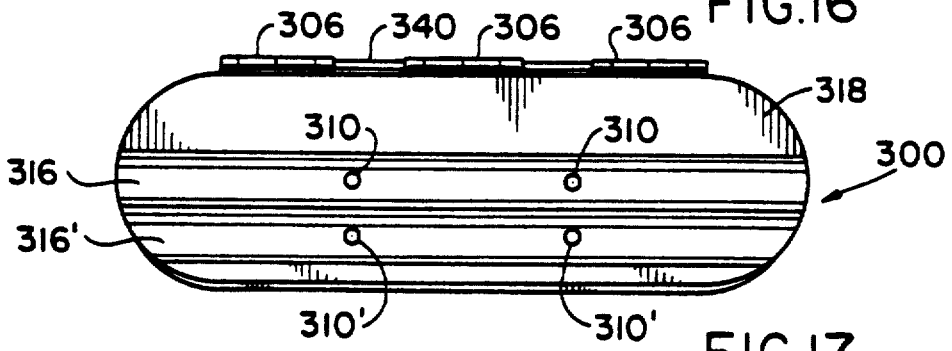
FIG. 17 is a bottom plan view of the wheelchair arm rest and storage compartment of FIG. 14.

Referring now to FIGS. 14–18, a wheelchair arm rest and storage compartment 300 according to a third embodiment of the present invention will now be described. Specifically, wheelchair arm rest and storage compartment 300 includes a lower tray member 302 and a cover member 304 hingedly secured on lower tray member 302 by hinges 306 such that cover member 304 opens in the widthwise direction of lower tray member 302. In such open position, the inner face of cover member 304 is horizontal, thus providing a useful work surface, for example, for the sorting of coins, holding of a cup or glass, food, etc. as in the embodiment of FIGS. 9–13. Hinges 306 can have hinge leaves molded with lower tray member 302 and cover member 304, or alternatively, can be separately secured thereto. Each hinge 306 can have its own hinge pin, or may use a common hinge rod 340, as shown in FIG. 15.

Figure 18:
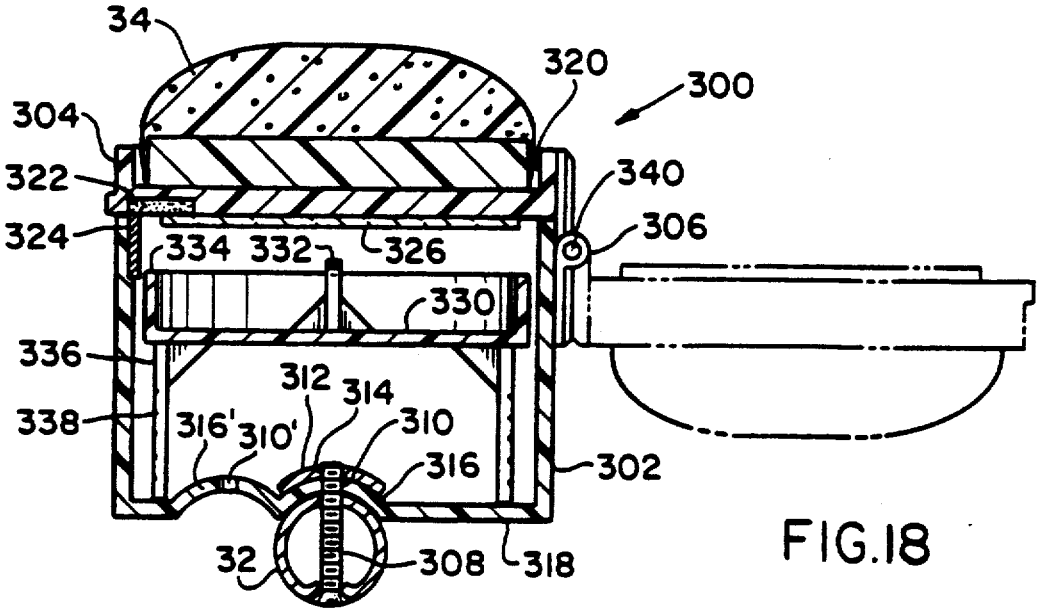
FIG. 18 is a cross-sectional view of the wheelchair arm rest and storage compartment of FIG. 14, taken along line 18—18 thereof, with the cover portion shown in an open position by chain lines.
Figure 19:
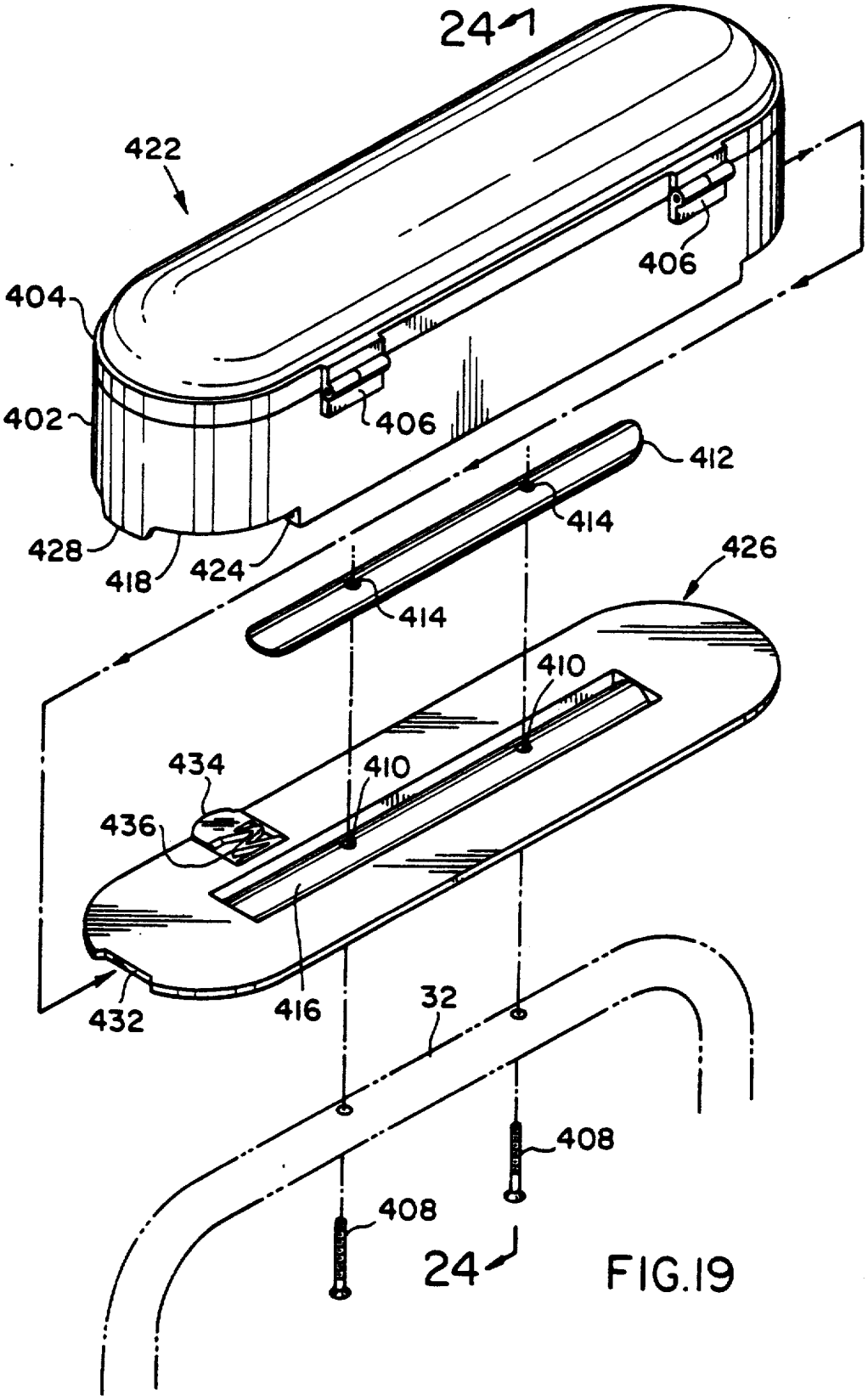
FIG. 19 is an exploded perspective view of a wheelchair arm rest and storage compartment according to a fourth embodiment of the present invention.
Figure 20:
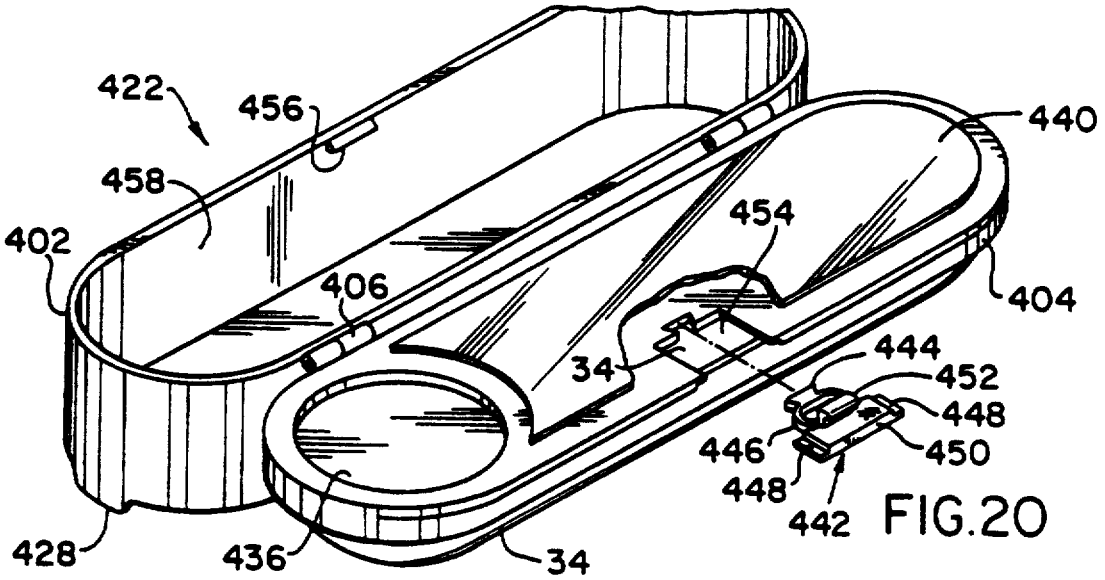
FIG. 20 is a perspective view of the wheelchair arm rest and storage compartment of FIG. 19, in a detached mode with its cover in an open position.
Figure 21:
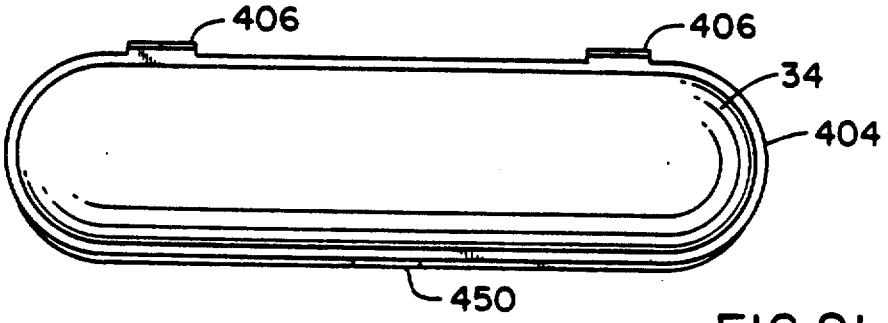
FIG. 21 is a top plan view of the wheelchair arm rest and storage compartment of FIG. 19.
Figure 22:
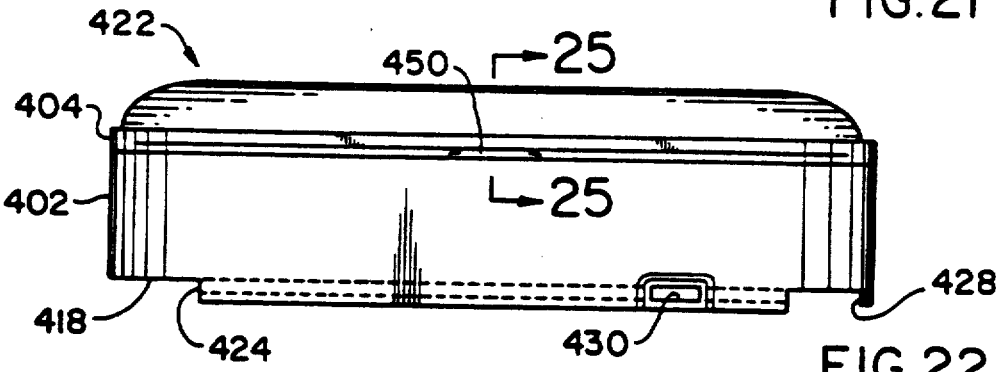
FIG. 22 is a hinge side elevational view of the wheelchair arm rest and storage compartment of FIG. 19.
Figure 23:
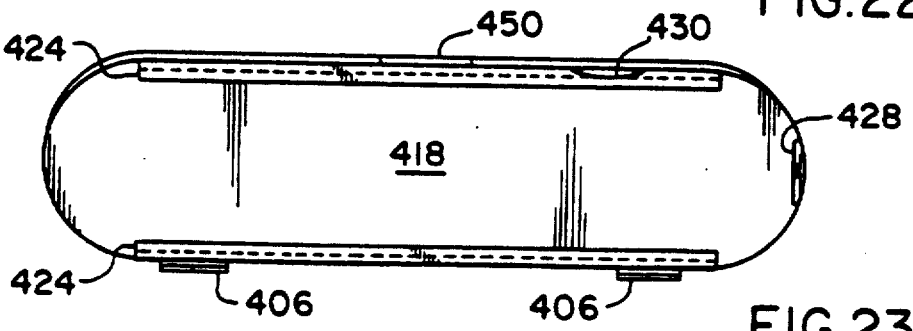
FIG. 23 is a bottom plan view of the wheelchair arm rest and storage compartment of FIG. 19.

Lower tray member 302 is secured to each upper horizontal member 32 by bolts 308 extending through apertures 33 therein, and which further extend through bolt holes 310 in an arcuate channel 316 in the bottom of lower tray member 302. The free ends of bolts 308 extend through screw-threaded apertures 314 in an arcuate clamp plate 312 positioned on the inner surface 318 of lower tray member 302 and seated on the convex inner surface thereat which is in opposition to arcuate channel 316, as best shown in FIG. 18. In this embodiment, arcuate channel 316 is formed substantially centrally of lower tray member 302. However, an additional, parallel arcuate channel 316' is formed adjacent arcuate channel 316 and has corresponding bolt holes 310'. In this manner, wheelchair arm rest and storage compartment 300 can be secured in two positions, namely an outboard and an inboard position, depending upon the design of the wheelchair, or the comfort of the user. Although only two arcuate channels 316 and 316' are shown, it will be appreciated that the present invention is not limited thereby, and more than two such arcuate channels can be provided. Also, if the wheelchair members 32 have other than an arcuate cross-section, such as a rectangular cross-section, the channels 316, 316' can be of such shape as to conform to the shape of members 32 to provide a high degree of structural integrity.

In addition, a tray or false bottom 328 can be provided within the interior of lower tray member 302. Tray 328 includes a flat base member 330 having a lip 334 secured to the periphery of base member 330, for retaining small items thereon. Four legs 336 are secured to the lower four corners of base member 330 and support the same above the inner surface of lower tray member 302. Legs 336 have break-away score marks which permit the break away portions of legs 336 and to thereby adjust the height of the legs 336 and tray 328, to accommodate storage of items below the tray 328 as well as on the tray 328. In order to remove tray 328, a lifting handle 332 is secured to the upper surface of base member 330.

In order to latch cover member 304 to lower tray member 302, a magnet 322 (such as a ferrite magnet) is adhesively secured to the inner surface of cover member 304 opposite the hinged edge thereof and cooperates with a mating metal member 324 secured to the inner, upper surface of the side wall of lower tray member 302. Metal member 324 can be made of steel or any other suitable magnetically attractable metal. Other suitable latches can be used, such as mechanical latches, integrally molded latches, etc.

Cover member 304 is formed with a surrounding side wall 305 which defines a nest 320 for receiving an upper cushion unit 34. Upper cushion unit 34 is formed by a plastic base 335 which is secured to cover member 304 within nest 320 by adhesive, screws or the like. Upper cushion unit 34 also includes a foamed cushion 343 adhered on plastic base 335. Foamed cushion 343 can be covered by a sheet-like covering (not shown), such as a vinyl-type material, cloth, leather, or other suitable covering material. In addition, the inner surface of cover member 304 can have a mirror 326 adhered thereto for the convenience of the wheelchair user.

In many instances, during a daily routine, the wheelchair user may travel to the office, go shopping to different stores and markets and spend time at home. Each activity may require different articles to be carried in the wheelchair arm rest and storage compartment, depending upon the activity. All of the above-described embodiments relate to wheelchair arm rest and storage compartments that are permanently fixed to the wheelchair arm.

Referring now to FIGS. 19–25, a quick release wheelchair arm rest and storage compartment 400 according to a fourth embodiment of the present invention will now be described. With this embodiment, the base mounting structure is permanently fixed to the wheelchair, and a wheelchair user can remove the storage compartment 422 for security reasons, or change the type of storage compartment 422 secured to the wheelchair, so as to provide one for work, one for shopping, one for home activities, etc. Other types of compartments can be set up to contain hobby tools and articles, cosmetics, manicuring tools, wallet, coins, comb, credit cards, medicines, telephone, etc. In such case, the user can select the compartment 422 for the anticipated activity, without having to change the contents thereof.

Specifically, storage compartment 422 includes a lower tray member 402 and a cover member 404 hingedly secured on lower tray member 402 by hinges 406 or other suitable pivotal connection, such that cover member 404 opens in the widthwise direction of lower tray member 402. In such open position, the inner face of cover member 404 is horizontal, thus providing a useful work surface, for example, as in the embodiment of FIGS. 9–13. Hinges 406 can have hinge leaves molded with lower tray member 402 and cover member 404, or alternatively, can be separately secured thereto. Each hinge 406 can have its own hinge pin, or may use a common hinge rod (not shown). Alternatively, an invisible interior hinge (not shown), or other suitable hinge structures could be used. The hinges 406, as well as the other hinges disclosed herein, could be living-type hinges.

A mounting flange 426 is secured to upper horizontal member 32 for mounting compartment 422 thereon. Mounting flange 426 is formed by an elongated, flat plate, and is secured to each upper horizontal member 32 by bolts 408 extending through apertures 33 therein, and which further extend through bolt holes 410 in a center, arcuate channel 416 in the mounting flange 426. The free ends of bolts 408 extend through screw-threaded apertures 414 in an arcuate clamp plate 412 positioned on the upper surface of mounting flange 426 at the position of arcuate channel 416, as best shown in FIG. 24.

Mounting flange 426 includes a cut-out section 432 at one shorter edge thereof, and also includes a detent 434 slidably fit in a guideway 435 of mounting flange 426. Detent 434 includes a spring member 436 formed integrally therewith which normally biases detent 434 outwardly past the respective longitudinal edge of mounting flange 426.

Figure 24:
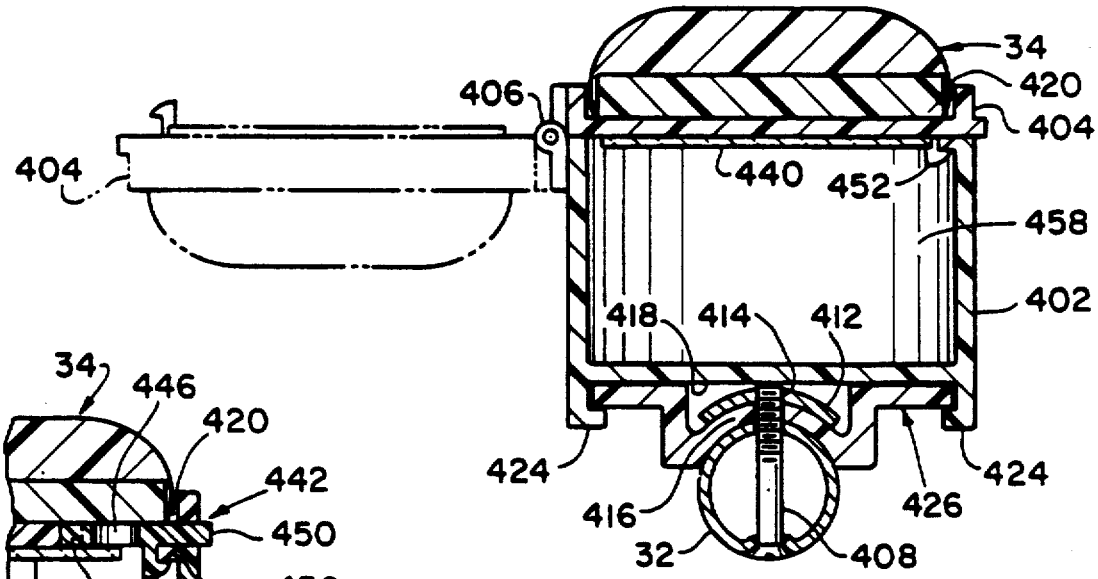
FIG. 24 is a cross-sectional view of the wheelchair arm rest and storage compartment of FIG. 19, taken along line 24—24 thereof, with the cover portion shown in an open position by chain lines.

The bottom wall of lower tray member 402 is formed with a pair of guide tracks 424, as best shown in FIG. 24, which engage around the longitudinal edges of mounting flange 426 to removably hold compartment 422 on mounting flange 426. The end face of lower tray member 402 includes a stop tab 428 that extends downwardly therefrom which seats against cut-out section 432 to correctly align compartment 422 with respect to mounting flange 426. In such position, detent 434 is biased into an aperture 430 in one guide track 424 to releasably lock compartment 422 onto mounting flange 426. It will therefore be appreciated that detent 434 can ride within the respective guide track 424 until it locks within aperture 430. To release compartment 422, the user merely depresses detent 434 inwardly, and slides compartment 422 along its lengthwise dimension so as to remove the same. After compartment 422 has been removed, another compartment can be releasably locked on mounting flange 426 in the same manner.

In order to latch cover member 404 to lower tray member 402, a latch mechanism 442 is secured to the inner surface of cover member 404 opposite the hinged edge thereof and cooperates with a mating strike 456 secured to the inner, upper surface of the side wall of lower tray member 402. Latch mechanism 442, as shown best in FIG. 20, includes an anchor wedge 444 which is received in a wedge- like recess 445 in cover member 404 to prevent escape of latch mechanism 442 from cover member 404. Latch means 442 also includes a spring loop 446 formed integrally with anchor wedge 444 and a release body 450 integrally formed with the opposite side of spring loop 446, release body 450 extending slightly past the longitudinal edge of cover member 404.

Figure 25:
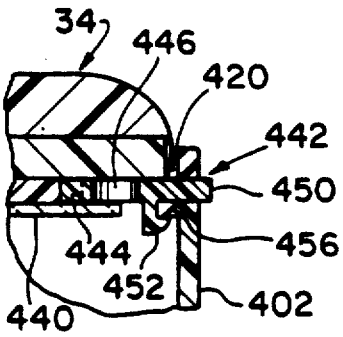
FIG. 25 is a cross-sectional view of a portion of the wheelchair arm rest and storage compartment of FIG. 22, taken along line 25—25 thereof.

A substantially rectangular recess 454 is formed in cover member 404 and is contiguous with wedge-like recess 445, for slidably receiving release body 450 therein. In this manner, guideways 448 are formed on opposite sides of release body 450 and slidably guide release body 450 in recess 454. It will be remembered that anchor wedge 444 is secured in wedge-like recess 445. Accordingly, any sliding movement of release body 450 occurs due to deformation and resilience of spring loop 446. Latch mechanism 442 also includes a catch 452 formed on release body 450 near the connection of release body 450 with spring loop 446. When cover member 404 is closed, catch 452 engages strike 456, as best shown in FIG. 25, to releasably lock cover member 404 to lower tray member 402. To release cover member 404, a slight inward pressure is applied to latch mechanism 442 so as to slide release body 450 inwardly and compress spring loop 446, and thereby remove catch 452 from strike 456, whereby cover member 404 can then be pivoted to its open position.

Cover member 404 is formed with a surrounding side wall 405 which defines a nest 420 for receiving an upper cushion unit 34 which is identical to the upper cushion unit 34 shown in FIGS. 14—19. In addition, the inner surface of cover member 304 can have a mirror 440 adhered thereto for the convenience of the wheelchair user. In addition, a cup holding recess 438 is formed adjacent mirror 440 on the inner surface of cover member 304.

In all of the above-described embodiments, it will be appreciated that various features described in one embodiment can be easily adapted to the other embodiments. For example, mirror 440 in the embodiment of FIG. 20 could be used with the embodiment of FIGS. 3–8. Also, tray 328 could be used with the other embodiments. Further, although hinge pins have been described with respect to hinges, the hinges which pivotally connect the cover member to the lower tray member, in the embodiments described above or in the following descriptions, can be living hinges or "invisible" interior hinges.

It will also be appreciated that the wheelchair arm rest and storage compartments according to the present invention can be easily adapted to mount on an array of bolt holes provided by different manufacturers of wheelchairs.

Figure 27:
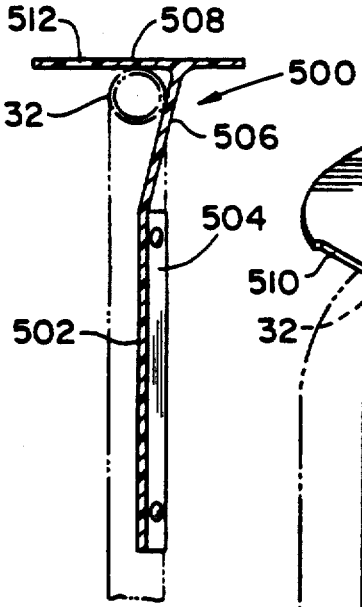
FIG. 27 is a cross-sectional view of the mounting flange of FIG. 26, taken along line 27—27 thereof.
Figure 26:
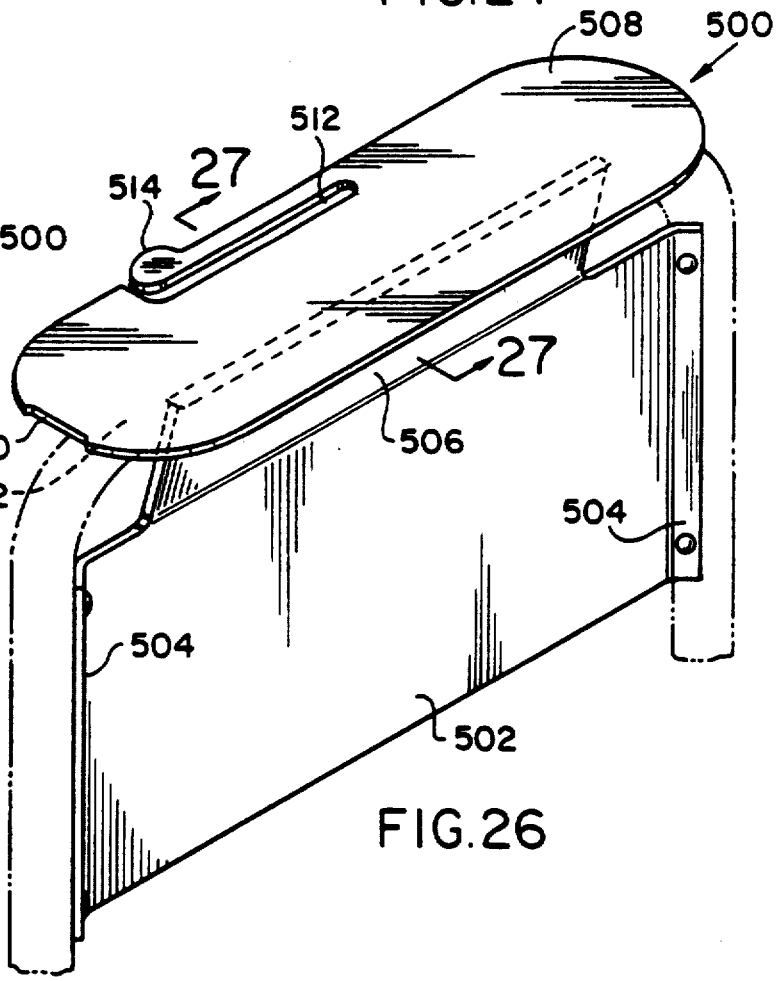
FIG. 26 is a perspective view of a mounting flange for a quick release storage device, in combination with a clothing guard panel, for a wheelchair according to another embodiment of the present invention.

Referring now to FIGS. 26 and 27, an assembly 500 of a quick release mounting flange and clothing guard according to another embodiment of the present invention, will now be described. Assembly 500 includes a vertical panel 502 with forward and rear generally L-shaped ends 504 having holes (not shown) therein to receive rivets 505 or the like so as to secure ends 504 to the downwardly extending legs 507 of inverted U-shaped arms 20 and 22 of the wheelchair. An angled extension 506 is integrally formed at the upper end of panel 502. Extension 506 is angled so as not to interfere with upper horizontal member 32 and to thereby bypass the same. The upper end of angled extension 506 extends to a height substantially equal to the upper surface of upper horizontal member 32. In this manner, a horizontally oriented mounting flange 508, which is integrally formed or connected (i.e. by welding) at the upper end of angled extension 506, rests on upper horizontal member 32 for extra support.

The vertical panel 502 of FIGS. 26 and 27, in addition to supporting the arm rest, serve as a clothing guard, to protect the user and his clothing from contact with the wheel of the wheelchair. This prevents soiling of the user's clothing, and also prevents having the user's clothing get caught in the rotating wheel structure of the wheelchair. Also, the vertical panel 502 prevents articles, which are placed on the chair portion, from falling out of the wheelchair and from interfering with rotation of the wheels.

Mounting flange 508 includes a cut-out section 510, which is similar to cut-out section 432 and serves the same purpose, namely to interact with stop 428 of compartment 422. Flange 508 is also formed with an elongated cut-out or slot 512 which forms a spring finger or detent 514 along one longitudinal edge of mounting flange 508. Spring finger 514 can thereby be biased in the widthwise direction of mounting flange 508 so as to engage within aperture 430 of compartment 422 to releasably lock the same onto mounting flange 508.

It will be appreciated that with the embodiment of FIGS. 26 and 27, there is no need to provide apertures 33 in upper horizontal members 32 to secure mounting flange 508 thereon. Accordingly, the structural integrity of upper horizontal members 32 is increased. Further, there is no need to use any clamp plates or the like for such securement. However, mounting flange 508 can also be attached to horizontal member 32 by means of screws or rivets 509, as shown schematically in FIG. 27, for extra support.

Figure 28:
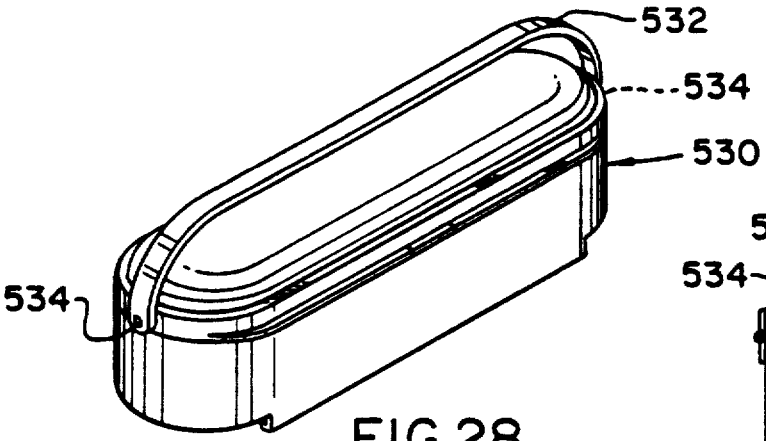
FIG. 28 is a perspective view of quick release storage device according to the present invention, for use with the mounting flange of FIG. 26, and having a handle thereon.
Figure 29:
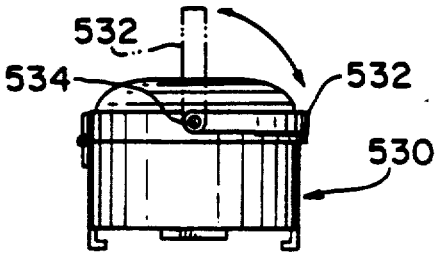
FIG. 29 is an end elevational view of the quick release storage device of FIG. 28.

Referring now to FIGS. 28 and 29, there is shown a removable storage compartment 530 according to another embodiment of the present invention, which is a modification of compartment 422 of FIGS. 19-25. Specifically, compartment 530 is similar to or identical to compartment 422, with the exception that compartment 530 further includes a carrying handle 532 that is pivotally secured to opposite ends of the cover member by pivot pins 534. A carrying strap or neck strap could be provided. The reason for providing handle or strap 532 is to enable compartment 530 to be carried by the wheelchair user in the event that he or she has to leave the wheelchair. In such case, there may be valuables o necessities in compartment 530 which the wheelchair user may wish to retain. If a neck strap 534 is provided, and if the compartment is provided with cosmetics and a mirror, this makes it convenient for a woman to hang the device on her neck while applying cosmetics, etc.

Figure 31:
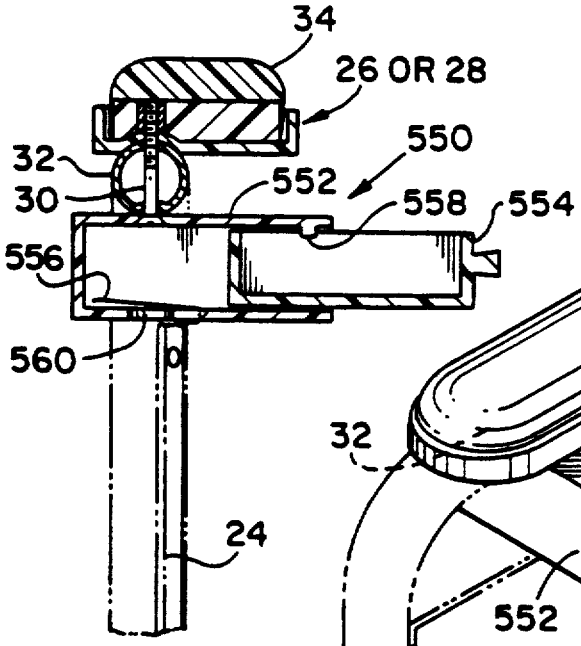
FIG. 31 is a cross-sectional view of the portion of the wheelchair of FIG. 30, taken along line 31—31 thereof.
Figure 30:
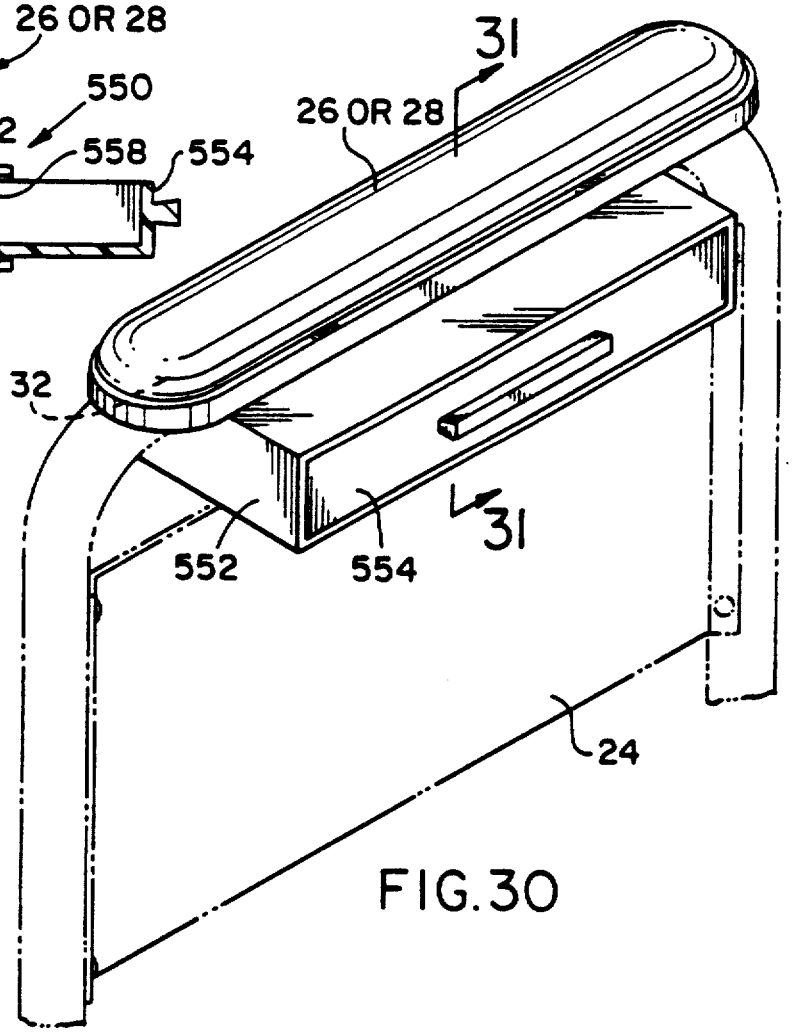
FIG. 30 is a perspective view of a portion of a wheelchair according to another embodiment of the present invention, having a drawer.

Referring now to FIGS. 30 and 31, a compartment 550 according to a further embodiment of the present invention is adapted to be releasably secured under upper horizontal member 32 and above clothing guard panel 24. Specifically, compartment 550 includes a rectangular box-like housing 552 which is hollow and is open at a side thereof. A drawer 554 is slidably retained within housing 552. In this regard, at least one leaf spring 556 is mounted on the inner surface of the bottom of housing 552 to retain drawer 554 in place and to thereby prevent drawer 554 from moving out of the opening in housing 552, due to vibrations or the like of the wheelchair. Further, housing 552 includes a depending stop member 558 at the inner surface of the top panel of housing 552 to prevent drawer 554 from moving too far out of the opening in housing 552.

In order to secure compartment 550 to the wheelchair, a plurality of countersunk bores 553 are formed in the top panel of housing 552. Bolts 30 extend through the top panel of housing 552 and then through apertures 33, and are then secured in upper cushion unit 34.

Although compartment 550 has been discussed in conjunction with a conventional upper cushion unit 34, it will be appreciated that compartment 550 can be used with any of the above-described wheelchair arm rest and storage compartments according to the present invention.

Figure 32:
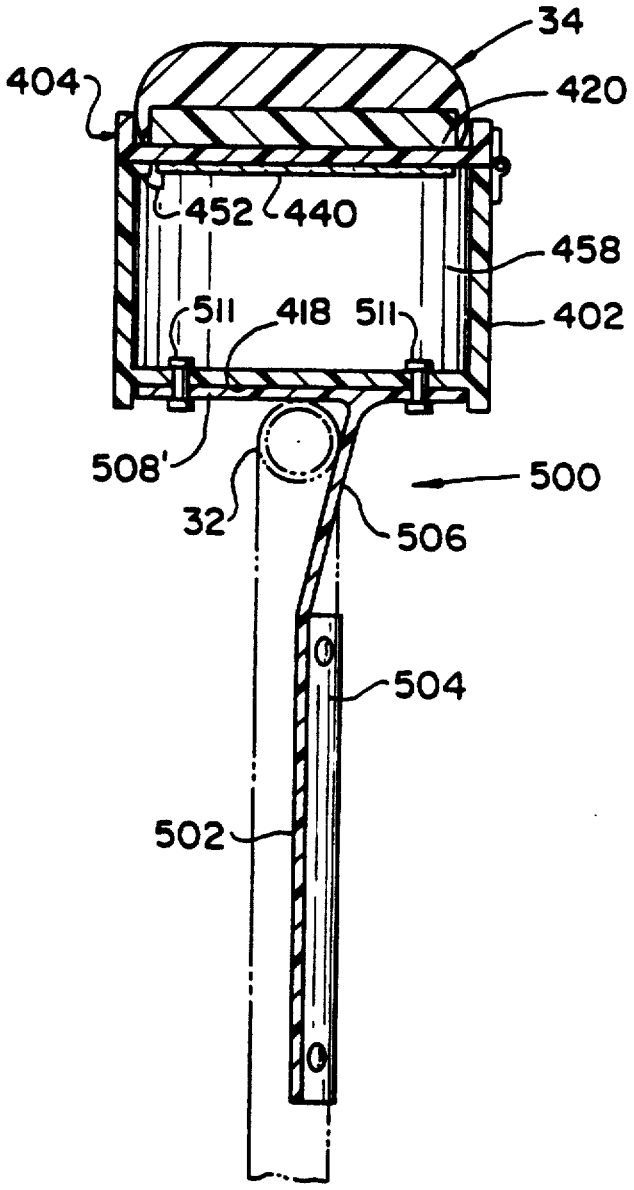
FIG. 32 is a cross-sectional view of the arm portion of another embodiment of the present invention.

Referring to FIG. 32, another embodiment of the present invention is illustrated, wherein the vertical panel 502 and its angled extension 506 are substantially identical to those shown in FIGS. 26 and 27. Also, the horizontal flange 508', attached to the upper surface of angle portion 506, is similar to flange 508 of FIGS. 26 and 27, except that the quick release mechanism thereof is omitted. In the embodiment of FIG. 32, the arm rest storage compartment is fixedly mounted to the horizontal flange 508', for example by means of bolts or rivets 511, which pass through the lower surface of the arm rest, as illustrated in FIG. 32. Additional rivets or bolts, such as 509 in FIG. 27 to further secure the device to the horizontal bar 32, could be provided, as desired. The structure of the arm rest storage compartment is substantially identical to that shown in FIG. 24, except that the hinge structure is moved to the opposite side of the device in the embodiment of FIG. 32, so that the arm rest cover 404 will open to the outside of the wheelchair. In this regard, it is pointed out that the device of FIG. 32 is arranged for the left arm of the wheelchair, whereas the device of FIG. 24 is arranged for the right arm of the wheelchair. Additionally, a false bottom member, with supporting legs, such as member 328 of FIG. 14, could be provided internally of the storage compartment, in the same manner as shown in FIG. 14, as desired. This not only provides a smooth bottom surface, or a compartmentalized bottom surface (depending upon the surface configuration of member 328), but also provides a hidden storage compartment below surface 330 of member 328, for storage of articles. The structure of FIG. 32 has a high degree of structural integrity and is particularly suitable for use with wheelchairs wherein a clothing guard 502 is desired, and wherein extremely high structural strength is required. The storage compartment of the other embodiments could be used with the mounting structure 500 of FIG. 32, as should be apparent.

The storage compartments of the present invention can also be used for storing a portable telephone, such as a cellular telephone, which is presently well known. Cellular telephone technology has been advanced and at present, very small units are available which can fit into a storage compartment of the type to which the present invention pertains. For example, the NEC P 9000 is particularly suitable for use due to its high degree of compactness. In order not to unduly complicate the drawings, a telephone has not been shown placed inside the storage compartment, but its use should be readily apparent, since the unit is battery operated and no external connections are required.

Although the present invention has been described with respect to a storage compartment for a wheelchair, the present invention is not limited thereby. For example, the present invention envisions the securement of storage devices, food trays, writing surfaces, game boards, entertainment devices, etc. to wheelchairs in either the fixed configuration or quick-release-type configuration. Also, various features from different embodiments can be used on the other embodiments, as desired and as applicable.

The storage compartment of the present invention is preferably molded from plastic materials, such as ABS, polypropylene or other similar materials. The arm cushion, however, is preferably fabricated of a foamed plastic material, which may be surface treated or covered with a fabric or the like for comfort and/or appearance purposes.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A removable storage compartment arrangement for a wheelchair of the type having at least one arm supporting structure, comprising:

a storage compartment, comprising:

lower tray means for holding at least one item, said lower tray means having an upper opening; and cover means mounted on said lower tray means for covering said upper opening of said lower tray means when said cover means is in a closed position, said cover means having an upper surface which provides an arm rest for a user of the wheelchair when it is in said closed position; and mounting means between said at least one arm supporting structure and said storage compartment; and releasable coupling means for releasably securing said lower tray means to said mounting to permit selective removal of said storage compartment from said arm supporting structure;

said releasable coupling means including:

guide means on one of said lower tray means and said mounting means;

engaging means on the other of said lower tray means and said mounting means for releasably engaging said guide means; and locking means for releasably locking said lower tray means to said mounting means after engagement of said engaging means with said guide means, said locking means being disengageable for permitting disengagement of said engaging means from said guide means for removal of said storage compartment from said mounting means.

2. A storage compartment according to claim 1, wherein said guide means comprises mounting flange means, and said engaging means is on said lower tray means for engaging said mounting flange means for releasably securing said lower tray means above said arm supporting structure of said wheelchair.

3. A storage compartment according to claim 2, wherein said mounting flange means is secured to the wheelchair at a position immediately above said at least one arm supporting structure of said wheelchair; and said engaging means includes guide track means for slidably retaining said lower tray means on said mounting flange means.

4. A storage compartment according to claim 3, further including stop means on one of said mounting flange means and said lower tray means, and means on the other of said mounting flange means and said lower tray means for engaging with said stop means when said lower tray means is slid on said mounting flange means to limit the extent of sliding movement of said lower tray means.

5. A storage compartment according to claim 3, further including engagement means on one of said lower tray means and said mounting flange means, and spring biased detent means on the other of said lower tray means and said mounting flange means for engaging with said engagement means when said lower tray means is fully engaged with said mounting flange means to releasably lock said lower tray means on said mounting flange means thereat.

6. A storage compartment according to claim 5, wherein said engagement means includes an aperture in said lower tray means, said mounting flange means includes a recess at a lengthwise edge thereof, and said spring biased detent means includes a detent slidably positioned in said recess for engagement within said aperture, and spring means for biasing said detent out of said recess and for connecting said detent to said mounting flange means.

7. A storage compartment according to claim 5, wherein said engagement means includes an aperture in said lower tray means, and said mounting flange means includes a slot extending lengthwise thereof adjacent one lengthwise edge to from a spring finger as said detent means for releasable engagement within said aperture in said lower tray means.

8. A storage compartment according to claim 1, wherein said arm supporting structure has an inverted generally U-shaped configuration with downwardly extending legs, and an upper substantially horizontal member; and said guide means is connected to said upper horizontal member.

9. A storage compartment according to claim 8, wherein said guide means comprises mounting flange means for releasably securing said lower tray means above said arm supporting structure of said wheelchair.

10. A storage compartment according to claim 1, wherein said arm supporting structure has an inverted generally U-shaped configuration with downwardly extending legs and an upper substantially horizontal member; and further including vertical panel means coupled between said downwardly extending legs and also coupled to said guide means for further connecting said guide means to said arm supporting structure.

11. A storage compartment according to claim 10, wherein said vertical panel member has a support portion extending outwardly therefrom toward the exterior of said wheelchair and coupled to said guide means at a position of said means which is horizontally spaced away from said supporting structure to provide two horizontally spaced apart mounting members for said guide means, thereby preventing rotation of said guide means relative to said supporting structure.

12. A storage compartment according to claim 11, wherein said guide means comprises mounting flange means, and said engaging means is on said lower tray means for releasably securing said lower tray means above said arm supporting structure of said wheelchair.

13. A storage compartment according to claim 12, further including a tray positioned in said lower tray means in spaced relation from a bottom wall of said lower tray means.

14. A storage compartment according to claim 13, wherein said tray includes a base plate and a plurality of legs extending from said base plate for spacing said base plate above the bottom wall of said lower tray means.

15. A storage compartment according to claim 10, wherein said guide means comprises mounting flange means, and said engaging means is on said lower tray means for releasably securing said lower tray means above said arm supporting structure of said wheelchair.

16. A storage compartment arrangement for a wheelchair of the type having at least one arm supporting structure, said storage compartment comprising:

an elongated lower tray means for holding at least one item, said lower tray means having an upper opening;

an elongated cover means mounted on said lower tray means for covering said upper opening of said lower tray means when said cover means is in a closed position, said cover means having an upper surface which provides an arm rest for a user of the wheelchair when it is in said closed position;

securing means for securing said elongated lower tray means to said at least one arm supporting structure of said wheelchair at at least two positions which are spaced apart in the longitudinal direction of said lower tray means; and connecting means coupled to said lower tray means at different positions laterally displaced, in a direction substantially perpendicular to said longitudinal direction, from said at least two spaced apart positions, and said connecting means being also coupled to said at least one arm supporting structure;

whereby said lower tray means is supported at laterally spaced apart positions by said securing means and said connecting means to prevent rotation of said lower tray means relative to said supporting structure.

17. A storage compartment according to claim 16, wherein said connecting means comprises a substantially vertical panel means coupled to said at least one arm supporting structure for serving as a clothing protector as well as to serve as a support for said lower tray means.

18. A storage compartment according to claim 16, wherein said arm supporting structure comprises an inverted generally U-shaped configuration with downwardly extending legs and an upper substantially horizontal member; and wherein said connecting means is coupled between said downwardly extending legs of said U-shaped configuration.

19. A storage compartment according to claim 18, wherein said connecting means comprises a substantially vertical panel means coupled to said at least one arm supporting structure for serving as a clothing protector as well as to serve as a support for said lower tray means, said substantially vertical panel means having a support portion extending outwardly therefrom toward the exterior of said wheelchair and coupled to said lower tray means at said laterally displaced different positions.

20. A storage compartment according to claim 16, wherein said connecting means comprises an outwardly extending member extending toward the exterior of said wheelchair, and coupled to said lower tray means at said laterally displaced different positions.

21. A storage compartment according to claim 20, wherein said connecting means comprises a substantially vertical panel member coupled to said outwardly extending member, said substantially vertical panel member serving as a clothing protector.

22. A storage compartment according to claim 16, wherein said lower tray means includes at least one partition means for defining a plurality of compartments in said lower tray means.

23. A storage compartment according to claim 16, further including latch means on said lower tray means and said cover means for releasably locking said cover means in said closed position.

24. A storage compartment according to claim 23, wherein said latch means includes a magnetically attractable material on one of said lower tray means and said cover means, and magnetic means on the other of said lower tray means and said cover means for magnetically attracting said magnetically attractable material when said cover means is in said closed position.

25. A storage compartment according to claim 16, further including false bottom means positioned in said lower tray means for providing a substantially flat inner, bottom surface for said lower tray means.

26. A storage compartment according to claim 16, wherein said cover means includes upper cushion means as said upper surface of said cover means for providing an arm rest for a user of the wheelchair.

27. A storage compartment according to claim 16, wherein said cover means includes an inner surface which is substantially horizontally oriented and forms a table surface when said cover means is fully opened.

28. A storage compartment for a wheelchair of the type having at least one arm supporting structure, said storage compartment comprising:

lower tray means for holding at least one item, said lower tray means having an upper opening; and cover means mounted on said lower tray means for covering said upper opening of said lower tray means when said cover means is in a closed position, said cover means having an upper surface which provides an arm rest for a user of the wheelchair when it is in said closed position; and means for releasably securing said lower tray means to said at least one arm supporting structure of said wheelchair to permit selective removal of said lower tray means and cover means from said arm supporting structure;

said releasably securing means comprising mounting flange means coupled to said arm supporting structure at a position immediately above said at least one arm supporting structure for releasably securing said lower tray means above said arm supporting structure of said wheelchair; and said lower tray means including guide track means for slidably engaging said mounting flange means for retaining said lower tray means on said mounting flange means.

29. A storage compartment according to claim 28, further comprising releasable locking means on at least one of said mounting flange means and guide track means for releasably locking said lower tray means onto said mounting flange means to secure said lower tray means to said arm supporting structure.

30. A storage compartment arrangement for a wheelchair of the type having at least one arm supporting structure, said storage compartment comprising:

an elongated lower tray means for holding at least one item, said lower tray means having an upper opening;

an elongated cover means mounted on said lower tray means for covering said upper opening of said lower tray means when said cover means is in a closed position, said cover means having an upper surface which provides an arm rest for a user of the wheelchair when it is in said closed position;

securing means for securing said elongated lower tray means to said at least one arm supporting structure of said wheelchair at a given position along the longitudinal direction of said lower tray means;

connecting means coupled to said lower tray means at a different position laterally displaced, in a direction substantially perpendicular to said longitudinal direction, from said given position, and said connecting means being also coupled to said at least one arm supporting structure;

whereby said lower tray means is supported at laterally spaced apart positions by said securing means and said connecting means to prevent rotation of said lower tray means relative to said supporting structure; and said cover means includes an inner surface which is substantially horizontally oriented and forms a table surface when said cover means is fully opened.

31. A storage compartment arrangement for a wheelchair of the type having at least one arm supporting structure, said storage compartment comprising:

an elongated lower tray means for holding at least one item, said lower tray means having an upper opening;

an elongated cover means mounted on said lower tray means for covering said upper opening of said lower tray means when said cover means is in a closed position, said cover means having an upper surface which provides an arm rest for a user of the wheelchair when it is in said closed position;

securing means for securing said elongated lower tray means to said at least one arm supporting structure of said wheelchair at a given position along the longitudinal direction of said lower tray means;

connecting means coupled to said lower tray means at a different position laterally displaced, in a direction substantially perpendicular to said longitudinal direction, from said given position, and said connecting means being also coupled to said at least one arm supporting structure;

whereby said lower tray means is supported at laterally spaced apart positions by said securing means and said connecting means to prevent rotation of said lower tray means relative to said supporting structure; and a tray positioned in said lower tray means in spaced relation from a bottom wall of said lower tray means, said tray including a base plate and a plurality of legs extending from said base plate for spacing said base plate above the bottom wall of said lower tray means.

* * * * *